United States Patent [19]

Quinn

[11] Patent Number: 4,640,468

[45] Date of Patent: Feb. 3, 1987

[54] DISC PULVERIZER

[76] Inventor: Bevan P. Quinn, Labtechnics Australia, P.O. Box 318, Glenside, South Australia, Australia, 5065

[21] Appl. No.: 757,638

[22] Filed: Jul. 22, 1985

[30] Foreign Application Priority Data

Jul. 31, 1984 [AU] Australia ..... PG6297

[51] Int. Cl.[4] ..... B02C 19/00

[52] U.S. Cl. ..... 241/199.1

[58] Field of Search ..... 241/215, 175, 199.1, 241/199.2, 199.3, 199.4

[56] References Cited

U.S. PATENT DOCUMENTS

| | | | |
|---|---|---|---|
| 745,416 | 12/1903 | Breakell | 241/212 |
| 1,776,411 | 8/1928 | Brainard . | |
| 3,416,740 | 8/1965 | Hodgson et al. . | |
| 4,212,430 | 7/1980 | Dale . | |

FOREIGN PATENT DOCUMENTS

| | | |
|---|---|---|
| 849639 | 9/1952 | Fed. Rep. of Germany . |
| 4479 | of 1903 | United Kingdom . |
| 119367 | 10/1918 | United Kingdom . |
| 160142 | 7/1921 | United Kingdom . |
| 212922 | 12/1924 | United Kingdom . |
| 701706 | 12/1979 | U.S.S.R. . |
| 869808 | 10/1981 | U.S.S.R. . |

*Primary Examiner*—Mark Rosenbaum
*Assistant Examiner*—Irene Graves Golabi
*Attorney, Agent, or Firm*—Steele, Gould & Fried

[57] ABSTRACT

A head for a laboratory rock pulverizer of the disc and bowl type. The bowl has shaped internal corners and a corresponding shaping on the disc enables the disc to ride up over charge in the bowl to assist with crushing. The disc may optionally include an aperture offset from its center. The bowl may include a hardened liner to take wear.

17 Claims, 9 Drawing Figures

DISC PULVERIZER

BACKGROUND OF THE INVENTION

1. Field of the Invention

This invention relates to improvements in disc pulverizers and particularly to heads useful on disc pulverization machines.

2. Prior Art

Pulverizer heads are generally of a type having a bowl with an annular ring within the bowl and a solid cylinder within the annular ring, both of which are moveable within the bowl and are used by placing a sample or charge of mineral or rock to be ground or pulverized within the bowl, placing a lid on the bowl and then the bowl on a shaker and oscillating it, such that the sample is crushed between the ring cylinder and bowl and ground finely.

The problem with such ring and cylinder pulverizer heads is, however, that the sample size, which can be prepared by such a device, is very small and if too much sample is put into the pulverizer head the ring and cylinder become clogged up and do not move in relation to the bowl and hence do not grind up the sample. Also such ring and cylinder grinder do not efficiently grind up larger pieces of sample and it is often necessary to place sample through a laboratory jaw crusher first to get it into a suitable size for pulverizing. SUMMARY OF THE INVENTION It is the aim of the present invention to provide a pulverizer or grinder head which will overcome at least some of the above problems by being able to accept a greater size range of material in the charge and larger charges without clogging and jamming.

It is to be understood that pulverizers or grinders of this type comprise a power driven platform adapted to be oscillated and upon which a grinder bowl may be clamped for the oscillatory motion. This specification is directed particularly towards the bowl or head for the grinder and the configuration of the disc within the bowl and hence it is to be understood when the term "head" or "grinder head" is used it refers to a bowl of the type adapted to be clamped to an oscillatory platform. The word "charge" will be used in this specification to designate the sample placed or to be placed within the bowl whether it be rock or mineral or other substance that is desired to be ground to a smaller particle size.

It should be noted, too, that the present invention also relates to a laboratory rock grinder heads of larger sizes such that the head is not easily removable from the oscillatory platform and hence is mounted permanently thereon. In such a case suitable means may be provided to clamp the lid to the bowl.

The invention may therefore be said to reside in a laboratory rock grinder head comprising a lid, a bowl and a grinder disc within the bowl characterized by the bowl having a substantially cylindrical shape and having a shaped surface between its internal side and its internal base and the disc being of a solid cylindrical shape and including a correspondingly shaped rim on its lower edge adapted in use to co-act with the shaped surface of the bowl.

It will be seen that by this invention there is provided a laboratory grinder head in which the disc can not only oscillate and orbit within the bowl to crush a charge but also with the bevelled surface on the disc co-acting with the bevelled surface on the body of the bowl then the disc can ride up over a charge within the bowl and the weight of the disc, in conjunction with its oscillating and orbiting motion, can crush larger pieces and the disc will not become jammed if it comes up to a larger piece because it will ride over the piece and assist in cracking the charge.

In one preferred embodiment the shaped surface comprises a curved surface and the correspondingly shaped rim comprises a curved rim.

In an alternative preferred embodiment the shaped surface comprises a straight angular bevel between the internal side and internal base of the bowl and the corresponding shaped rim on the disc comprises an angular bevel.

In a preferred embodiment of the invention, the disc may further include at least one aperture through the disc in the direction of the cylindrical axis.

Such an aperture or apertures may be circular and may have a diameter of from 15 to 40 percent of the diameter of the disc.

It has been found that the addition of the aperture in the disc assists with the grinding action, as sample which has been ground can move up through the aperture as the disc is orbiting and oscillating such that sample or charge underneath the disc is continually being replaced by a type of "pumping" action caused by the disc orbiting.

In a preferred form the aperture may be circular and may taper from the top surface to the bottom surface of the disc.

Such an aperture may be offset from the centre of the disc.

The bottom surface of the disc may also have a very slight conical shaping.

By this conical shaping when the rim of the disc rides up onto the angled surface on one side of the bowl then one portion of the disc base will be almost parallel to the base of the bowl to provide a fine grinding surface.

In a further preferred embodiment the angled surface in the bowl may make an angle of between 20 degrees to 35 degrees to the planar base of the bowl.

Similarly, the bevelled rim of the disc may make an angle of from 20 degrees to 35 degrees to the base of the disc.

In a preferred embodiment of the invention the angled surface within the bowl may be comprised of two angular portions, an inner portion and an outer portion, with the inner portion being of a smaller angle to the planar base than the outer portion.

The bowl may include an outer shell and an inner liner with the inner liner being made of a harder wearing material than the shell.

By this means a relatively economic main bowl may be made with replaceable liners to be replaced as wear in the bowl occurs.

The disc may further include a stepped shoulder on the upper rim. This stepped shoulder may assist with crushing of larger rock samples as it catches larger pieces between the edge of the rim and the side of the bowl as the disc oscillates and orbits about in the bowl.

The diameter of the disc may be from 70 to 90 percent of the inner diameter of the bowl.

It will be seen that by this invention there is provided a rock grinder head which is of relatively simple construction but which can efficiently grind rock samples.

Brief Description of the Drawings

To more clearly assist with understanding of the invention however reference will now be made to the accompanying drawings which show preferred embodiments of the invention.

In the drawings.

Detailed Description of the Preferred Embodiments

Figure 1:
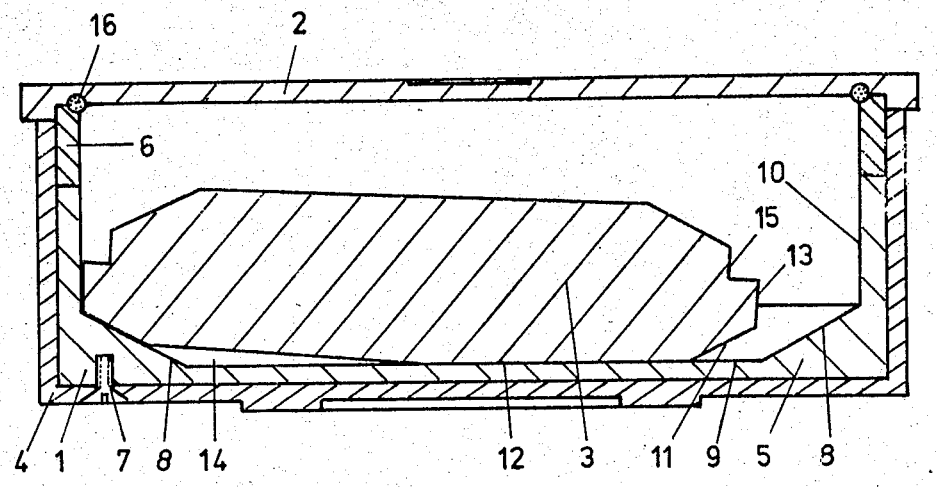
FIG. 1 shows a cross-sectional view of one embodiment of a rock grinder according to this invention.

Now looking more closely at the drawings and particularly in relation to the embodiment of the laboratory rock grinder head according to this invention it will be seen that the head includes a bowl 1, a lid 2 and a disc 3 within the bowl. The bowl 1 comprises a shell 4 with a liner 5 and a packing sleeve 6. Screw 7 holds the liner 5 into the bottom of the shell 4. The sleeve 6 may be fastened to the shell by any known convenient means.

The liner 5 includes an internal angle 8 between the internal base 9 and the internal side 10. The angled surface 8 is continuous around the full diameter of the inside of the bowl.

The disc 3 includes a corresponding angled surface 11 between the base of the disc 12 and the side of the disc 13. As can be seen on the left-hand side of FIG. 1 the disc can ride up onto the angled surface 8 in use so that a void space 14 is produced under the disc and sample collected in this area will be crushed as this disc oscillates.

The disc 3 also includes a stepped rim 15 which assists with the crushing of larger rock samples.

Lid 2 includes a sealing O-ring 16 between the lid and sleeve 6 so that dust will not be lost from the head during grinding.

Figure 2:
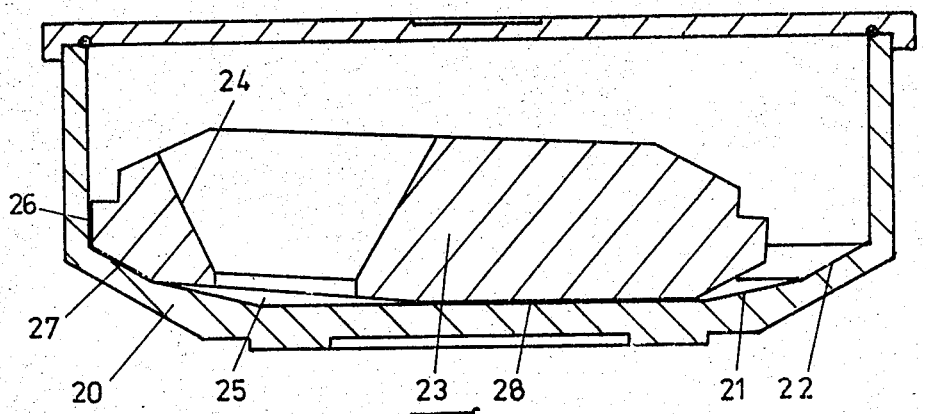
FIG. 2 shows a cross-sectional view of an alternative embodiment of rock grinder according to one embodiment of this invention.

FIG. 2 shows an alternative embodiment of a laboratory rock grinder head according to this invention and in this embodiment the bowl 20 is comprised of a single piece of steel or other suitable material. The angled inner surface of the bowl is comprised of an inner portion 21 and an outer portion 22 once again continuous around the length of the periphery of the inside of the bowl. The two angled portions assist with enabling the disc to ride up the angled surface of the bowl.

In this embodiment the disc 23 includes an angled aperture 24 through the disc in the direction of the cylindrical axis of the disc but offset from the cylindrical axis and with the walls of the aperture tapered from a wider diameter at the top surface of the disc to a smaller diameter at the lower surface of the disc.

With the rock grinder of this embodiment in use charge which is trapped in the void area 25 below the disc may be caused to be "pumped" up through the aperture 24 to the top of the disc so that new sample can be caught underneath the disc and continuous flow or charge for grinding can occur. It will be apparent that such pumping must occur in the illustrated device due to the angling of the walls of aperture 24 as the disc moves eccentrically and tilts in the bowl. Such pumping must also occur whenever the disc is more dense than the charge.

It may be true that in some stages of grinding sample may pass down through the aperture to reach the region 25 underneath the disc where grinding occurs.

It will be realized too that fine grinding of the sample will occur between the surfaces 26 and 27 where intimate contact of the disc and bowl occurs as well as at the junction of surfaces 28.

Figure 3:
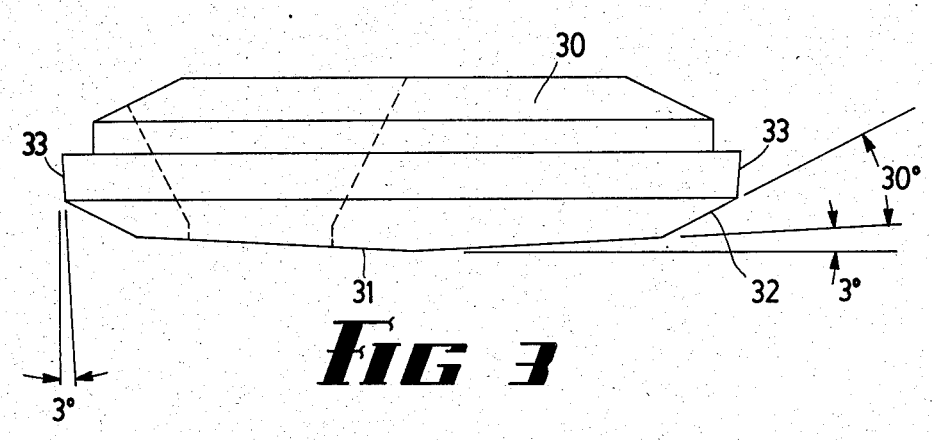
FIG. 3 shows a side view of a disc according to this invention.

Now looking at FIG. 3 which shows one embodiment of a disc according to this invention, it will be seen that the disc 30 includes a slightly conical base 31 with an angle of approximately 3 degrees from a nominal horizontal base to the angle of the conical shaping. The bevelled rim 32 makes an angle of approximately 30 degrees with the lower surface of the disc.

The outer periphery 33 of the disc makes an angle of approximately 3 degrees with the notional vertical sides of the disc such that in use when the loose and eccentric disc is moved and tilted, the slightly conical base of the disc is horizontal then the sides of the disc are parallel with the sides of the bowl.

Figure 4:
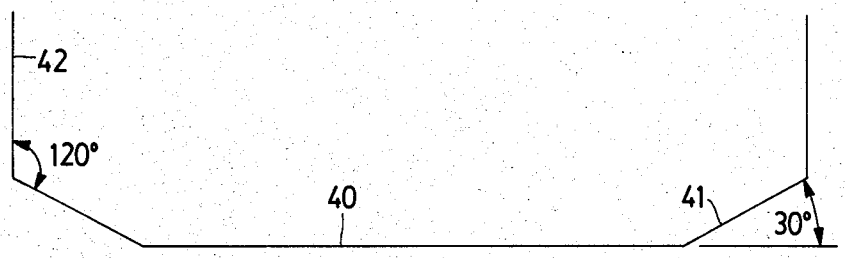
FIG. 4 shows the internal angles of a bowl according to one embodiment of the invention.

As can be seen in FIG. 4 which shows an outline of an inner surface of one embodiment of the bowl, the angled surface 41 makes an angle of 30 degrees with the base of the bowl 40 or 120 degrees with the side of the bowl 42.

Figure 5:
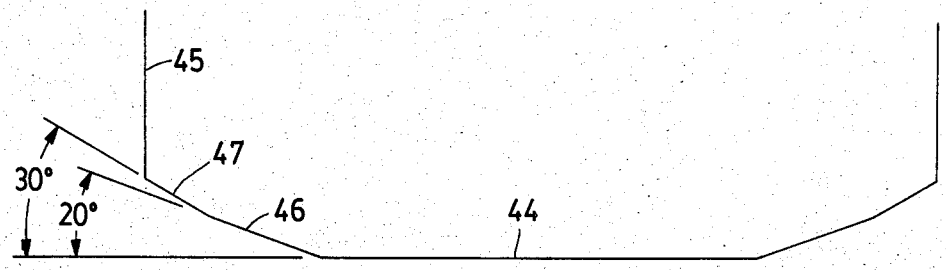
FIG. 5 shows an alternative embodiment of the inner angles of a bowl according to one embodiment of this invention.

In an alternative embodiment of the invention as shown in FIG. 5 the angled surface between the base of the bowl 44 and the side of the bowl 45 includes an inner angled portion 46 at an angle of 20 degrees and an outer angled portion 47 at an angle of 30 degrees.

It will be realized that the angles given are examplary only and variation in them is possible.

Figure 6:
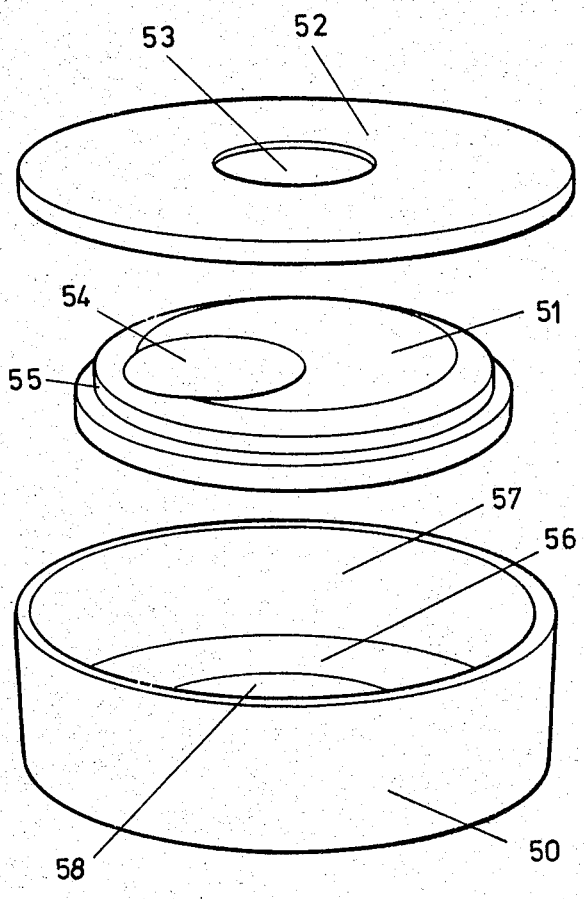
FIG. 6 shows an exploded view of the components of a rock grinder according to one embodiment of the invention.

Now looking at FIG. 6, it will be seen that the laboratory rock grinder head according to this invention comprises a bowl 50, a disc 51 and a lid 52. The lid 52 includes a recess 53 into which a clamping means is received when the head is in use. The disc 51 includes the offset aperture 54 and stepped rim 55 to assist with crushing of larger rock samples. The bowl 50 includes the inner angled surface 56 between the inner sides 57 and base 58.

Figure 7:
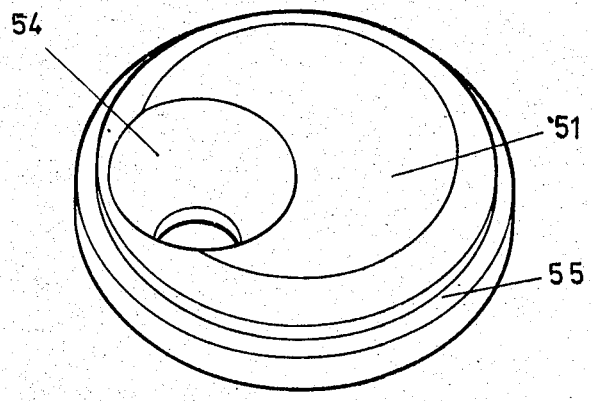
FIG. 7 shows a top perspective view of a grinder disc according to one embodiment of this invention.

As shown in FIG. 7 the disc includes the stepped rim 55 and aperture 54 extending through the disc at a position offset from the centre of the disc.

Figure 8:
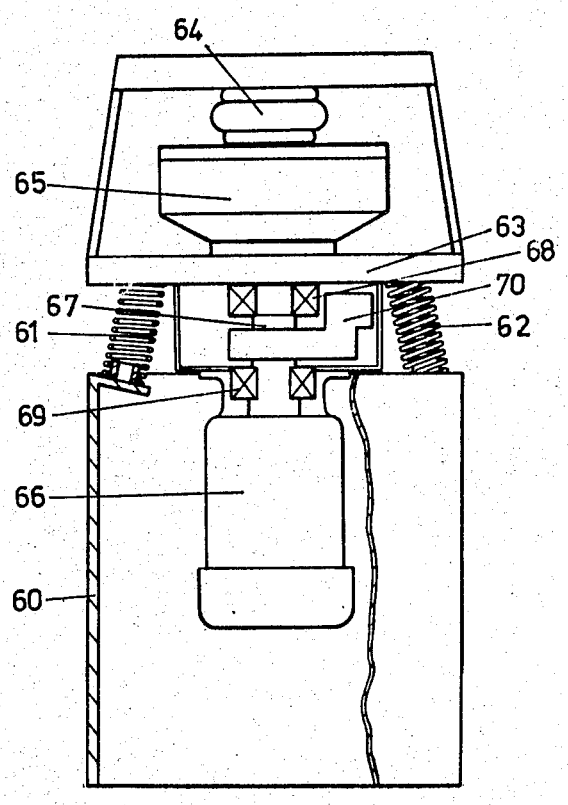
FIG. 8 shows a part sectional view of a laboratory rock grinder of the type adapted for holding the head of the rock grinder according to the present invention.

Now looking at FIG. 8, which shows a laboratory rock grinder according to this invention, it will be seen that the device comprises a base 60 upon which is supported by springs 61 and 62 a head frame 63. The head frame 63 includes pneumatic clamping means 64 clamping a laboratory rock grinder head 65 between the pneumatic clamping means 64 and the frame 63.

A motor 66 is suspended from the frame 63 and shaft 67 extending from the motor is supported in bearings 68 and 69 with a large eccentrically pivoted weight 70 on the shaft 67 between the bearings 68 and 69.

As the motor 66 spins the eccentrically supported weight as the motor is mounted onto the frame 63 the whole assembly vibrates on springs 61 and 62 causing the head 65 to oscillate and orbit to cause the disc within the head to orbit to crush and grind sample.

When grinding is complete pneumatic clamping means 64 is released and the head 65 can be removed from the grinder for removal of the charge.

Figure 9:
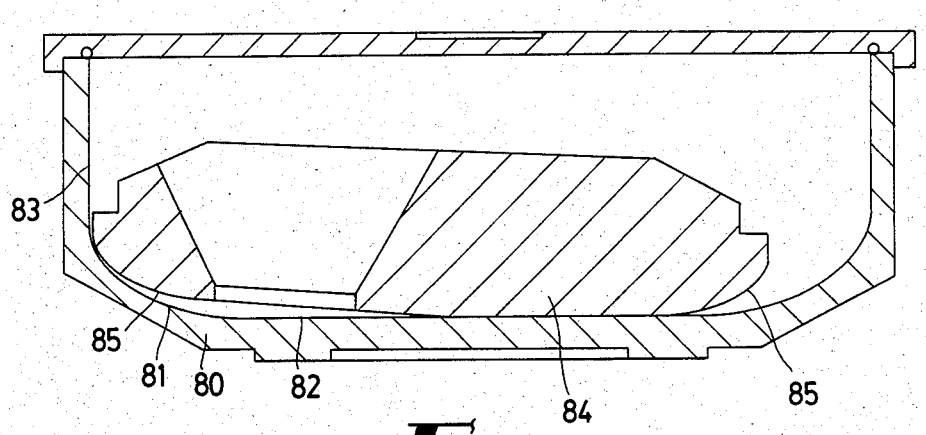
FIG. 9 shows an alternative embodiment of the invention wherein the peripheral internal base of the bowl is curved and the disc is correspondingly curved.

In FIG. 9 an alternative embodiment of a pulverizer head according to this invention is shown in which the bowl 80 has curved internal peripheral surface 81 between the flat base 82 and the side 83. The disc 84 has a corresponding curved lower rim 85. Once again the curve will encourage the disc to ride up over material to provide an enhanced pulverizing action.

Overall, it will be realized that by this invention there is provided a grinder or pulverizer head having a large grinding surface on the sides and bottom of the disc which provides a good stirring action which is set up as the disc rotates or orbits with sample being caught on the edge of the disc and forced under the disc. In the embodiment of the disc which includes an aperture then the sample will eventually escape through the aperture. By this continuous stirring action no sample may remain trapped in the aperture and not get ground. The sharp shoulder on the upper rim of the disc enables larger rocks to be crushed that would normally just sit on top of the disc or ring in a disc and ring type grinder.

The bottom of the bowl and disc is shaped such that the disc is in contact with the edge and angled side as well as part of the bottom to provide a large grinding surface and the aperture if provided may be positioned so that this is not over the centre of the bowl and hence all of the bottom surface may be used in the grinding.

As discussed earlier, the bowl may be of a unitary construction and made of a steel which can after manufacture be sufficiently heat treated to make it very hard or the liner may be of a hardenable steel with the shell and sleeve being of a softer cheaper steel.

The claims defining the invention are as follows:

1. A laboratory rock grinder head, comprising:

a bowl and a loose grinder disc movable within the bowl, the disc being smaller than the bowl and eccentrically movable within the bowl as the bowl is agitated, the bowl defining a substantially cylindrical internal shape, the bowl having a sloping shaped surface between an internal side and internal base of the bowl, and the disc having a generally cylindrical shape with an angled edge, the angled edge of the disc being complementary with the internal side and internal base of the bowl, such that a varying gap between the disc and bowl occurs under the disc as the disc is moved eccentrically in the bowl and as the disc rides up on the shaped surface of the bowl, and the angled edge of the disc rests squarely against the internal shape of the bowl.

2. A laboratory rock grinder head as in claim 1 wherein the shaped surface comprises a curved surface and the correspondingly angled edge comprises a curved rim.

3. A laboratory rock grinder head as in claim 1, wherein the inside of the bowl defines an angled surface comprised of two angular portions, an inner portion and an outer portion, the inner portion being of a smaller angle to the planar base than the outer portion.

4. A laboratory rock grinder head as in claim 1, wherein the disc includes at least one aperture therethrough in the direction of the cylindrical axis.

5. A laboratory rock grinder head as in claim 4 wherein the at least one aperture, is circular and has a diameter of from 15 to 40 percent of the diameter of the disc.

6. A laboratory rock grinder head as in claim 4 wherein the at least one aperture, is circular and tapers from the top surface to the bottom surface of the disc.

7. A laboratory rock grinder head as in claim 4 wherein the at least one aperture is offset from the centre of the disc.

8. A laboratory rock grinder head as in claim 1, wherein the bottom surface of the disc has a very slight conical shaping.

9. A laboratory rock grinder head as in claim 1 in which the shaped surface comprises a straight angular bevel between the internal side and internal base of the bowl and the corresponding angled edge on the disc comprises an angular bevel.

10. A laboratory rock grinder head as in claim 9, wherein the shaped surface of the bowl is an angled bevel defining and angle of between 20 to 35 degrees to a planar base of the bowl, an edge of the disc riding up on the angled level as the disc is moved eccentrically.

11. A laboratory rock grinder head as in claim 1, wherein the correspondingly of the disc angle edge is at an angle of from 20 to 35 degrees to the base of the disc.

12. A laboratory rock grinder head as in claim 1 wherein the bowl includes an outer shell and an inner liner, the inner liner being of a harder wearing material than the shell.

13. A laboratory rock grinder head as in claim 1, wherein the disc further includes a stepped shoulder upon the upper rim.

14. A laboratory rock grinder head as in claim 1, wherein the diameter of the disc is of from 70 to 90 percent of the inner diameter of the bowl.

15. A laboratory rock grinder head, comprising:

a bowl and a loose disc movable within the bowl, the disc being smaller than the bowl and eccentrically movable within the bowl, the bowl having a sloping surface between a side wall and bottom of its internal surface, the disc having a sloped bottom and angled edge, the sloping surface, sloped bottom and angled edge being complementary such that when the angled edge of the disc is placed against the side wall of the bowl above the slope during eccentric movement of the disc, the sloped bottom of the disc is aligned flat against the bottom of the bowl and a gap is defined between the disc and the bowl adjacent the sloping surface.

16. A laboratory rock grinder head is in claim 15, wherein the bowl has a planar base and perpendicular walls, and the sloping surface defines an angle of 20 to 35 degrees to the base.

17. A laboratory rock grinder head as in claim 16, wherein the sloped bottom of the disc is conical and has an angle of about 3 degrees and the angled edge of the disc is parallel to the side wall of the bowl when the disc rests on the sloped bottom.

* * * * *